United States Patent [19]

Yumiyama et al.

[11] Patent Number: 4,747,761

[45] Date of Patent: May 31, 1988

[54] SILENCER-CARRYING ROTARY VANE PUMP

[75] Inventors: Shigeru Yumiyama; Takaki Kamiyama, both of Katsuta, Japan

[73] Assignee: Hitachi, Ltd., Tokyo, Japan

[21] Appl. No.: 872,906

[22] Filed: Jun. 11, 1986

[30] Foreign Application Priority Data

Jun. 17, 1985 [JP] Japan ..... 60-129845

[51] Int. Cl.[4] ..... F04C 18/344; F04C 29/06; F01N 1/10

[52] U.S. Cl. ..... 418/46; 418/181; 417/312; 181/272; 181/274

[58] Field of Search ..... 418/46, 86, 181, 270, 418/259; 181/256, 272, 274, 403; 417/312

[56] References Cited

U.S. PATENT DOCUMENTS

| | | | |
|---|---|---|---|
| 2,057,262 | 10/1936 | Osgood | 181/274 |
| 2,643,731 | 6/1953 | Schmid | 418/181 |
| 2,764,342 | 9/1956 | Dills | 418/181 |
| 3,459,275 | 8/1969 | Prillwitz et al. | 418/181 |
| 3,936,238 | 2/1976 | Wycliffe | 418/181 |
| 4,457,671 | 7/1984 | Watanabe | 418/181 |

FOREIGN PATENT DOCUMENTS

| | | | |
|---|---|---|---|
| 58-88485 | 5/1983 | Japan . | |
| 1017831 | 1/1966 | United Kingdom | 418/181 |

*Primary Examiner*—John J. Vrablik

*Attorney, Agent, or Firm*—Antonelli, Terry & Wands

[57] ABSTRACT

A silencer-carrying rotary vane pump wherein a hollow portion is provided between inner and outer circumferential walls of a cylindrical center case of the vane pump. The hollow portion is closed with side covers to form a sealed chamber through which a pumped out medium is discharged to the outside. A plurality of partitions may be provided in a portion of the sealed chamber to divide the sealed chamber into a plurality of sealed compartments, with adjacent compartments being in communication with each other by a passage having a small cross-sectional area. Soundproof members may be provided in the sealed compartments and an additional discharge port may be provided for communicating the sealed chamber with the outside of the pump.

2 Claims, 2 Drawing Sheets

SILENCER-CARRYING ROTARY VANE PUMP

BACKGROUND OF THE INVENTION

This invention relates to a rotary vane pump, and, more particularly, to a silencer-carrying rotary vane pump suitably used as an oilless rotary vane pump.

The known silencers for the sound of a fluid in a vacuum pump inlcude a silencer formed of, for example, a space in a case for a pump driving motor as shown in, for example, Japanese Utility Model Laid-Open No. 165269/1983, or a sealed dead space around the outer circumferential surface of a shaft coupling provided between a pump driving motor and a pump as shown in, for example, Japanese Patent Laid-Open No. 88485/1983.

However, in these prior art silencers, no consideration is given to the reduction of the frictional sound, which is one of the causes of the noise in a rotary vane pump, of the vanes slidingly moving along the inner circumferential surface of a pump casing.

An object of the present invention is to minimize the above noted problems of noise in conventional techniques, especially, the frictional sound of the vanes in a rotary vane pump, and thereby provide a lower-noise rotary vane pump.

The characteristics of the present invention reside in that a hollow portion is provided between the inner and outer circumferential walls of a cylindrical center case of a rotary vane pump, which hollow portion is closed with side covers to form a sealed chamber, through which a pumped out medium is discharged to the outside. This structure enables the sound of a flow of the pumped or discharged medium to be minimized, and the sealed chamber to be utilized as a soundproof layer for preventing the propagation of the frictional sound of the vanes which are slidingly moved along the inner circumferential wall of the center case of the pump. This makes it possible to provide a lower-noise rotary vane pump.

DESCRIPTION OF THE PREFERRED EMBODIMENTS

Figure 1:
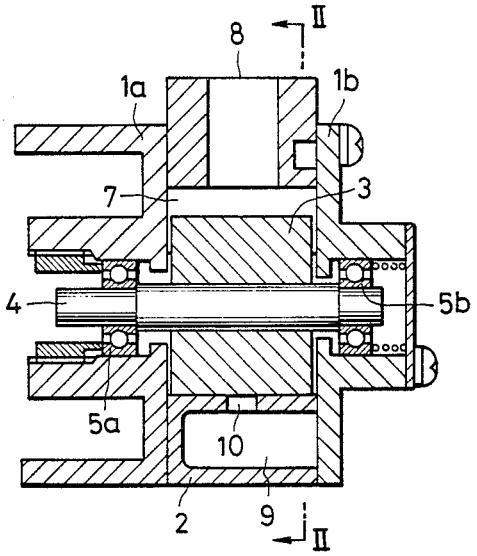
FIG. 1 is a longitudinal cross-section view of an embodiment of a rotary vane pump according to the present invention.
Figure 2:
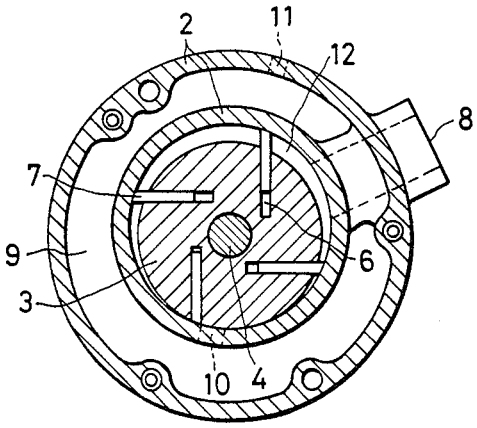
FIG. 2 is a cross-sectional view taken along the line II—II in FIG. 1.

Referring now to the drawings wherein like reference numerals are used throughout the various views to designate like parts and, more particularly, to FIGS. 1 and 2, according to these figures, according to the present invention, a rotary vane pump includes a rotor 3 provided on an inner side of a cylindrical center case 2 which is closed at both ends thereof with side covers 1*a*, 1*b*. The rotor 3 is rotatably supported on bearings 5*a*, 5*b*, which are provided on both sides of the rotor 3, via a rotor shaft 4 formed integrally with the rotor 3. The rotor shaft 4 is adapted to be rotated by, for example, an electric motor (not shown). In the grooves 6 provided in the rotor 3, vanes 7 are held so that the vanes 7 can be slidingly moved in a radial direction. When the rotor 3 is rotated, the vanes 7 contact the inner circumferential surface of the center case 2 due to the centrifugal force. A moat-like groove is provided between the inner and outer circumferential walls of the center case 2, and closed with the side covers 1*a*, 1*b* to form a sealed chamber 9.

A suction port 8, which is communicated with the outside of the center case 2, and a discharge port 10, which is communicated with the sealed chamber 9, are made in suitable portions of the inner circumferential wall of the center case 2. The cross-sectional shape of the interior of the center case 2 is determined so that the volume of a space 12 defined by the center case 2, vanes 7 and side covers 1*a*, 1*b* is large in a vicinity of the suction port 8, and small in a vicinity of the discharge port 10. Accordingly, when the rotor 3 is rotated, a pumping operation, in which a fluid medium, such as the air is drawn from the suction port 8 and discharged from the discharge port 10 into the sealed chamber 9, is carried out. The medium discharged from the discharge port 10 is supplied or discharged from a discharge port 11 to the outside through the sealed chamber 9.

Therefore, even when the sound of fluid occurs when the medium drawn from the suction port 8 is compressed and discharged from the discharge port 10 in this embodiment, in which the volume of the space 12 in which a pumping operation is carried out, is large in the vicinity of the suction port 8 and small in the vicinity of the discharge port 10, the medium is discharged to the outside through the sealed chamber 9 to minimize the sound, whereby the pump can be effectively silenced. The frictional sound, which is generated when the vanes 7 are slidingly moved in the radial direction in the grooves 6 in the rotor 3 and rotated by the centrifugal force as they contact the inner circumferential wall of the center case 2, is also rarely transmitted to the outside since the space in the sealed chamber 9 works as a soundproof layer.

Due to the sealed soundproof chamber 9 provided around the outer circumferential surface of the inner wall of the center case 2, the pump can attain a larger soundproofing effect than a pump provided with a soundproof chamber at some other part thereof, without causing an increase in the total volume of the pump and the propagation of noise to the outside thereof.

In the embodiment of FIGS. 1 and 2, the discharge ports 10, 11 in the inner and outer circumferential walls of the center case are staggered at about 180°, so that the compressed air from the discharge port 10 can be diffused sufficiently into the sealed chamber 9, thereby enabling the fluid sound to be reduced to a satisfactory extent.

Figure 3:
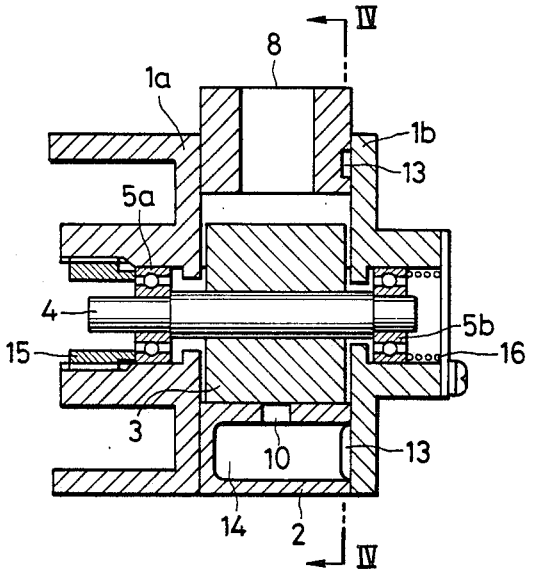
FIG. 3 is a longitudinal cross-section view along line III—III of FIG. 4 of another embodiment of a rotary vane pump according to the present invention.
Figure 4:
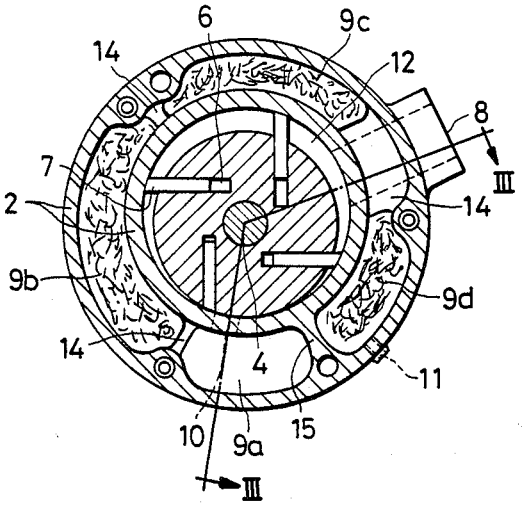
FIG. 4 is a cross-sectional view taken along the line IV—IV in FIG. 3.

In the embodiment of FIGS. 3 and 4, partitions 14 are provided between a discharge port 10 of a sealed chamber 9 and a discharge port 11, by which the sealed chamber 9 and the outside are communicated with each other. The sealed chamber 9 is divided into four compartments, and the adjacent compartments are communicated with each other via a passage 13 of a small cross-sectional area. In this structure, the medium discharged from the discharge port 10 passes through the sealed compartments 9*a*, 9*b*, 9*c*, 9*d*, and is discharged from the discharge port 11 to the outside. The sealed chamber is provided with another partition 15, whereby the fluid discharged from the discharge port 10 passes through the sealed compartments 9*a*, 9*b*, 9*c*, 9*d* in the mentioned order to be led from the discharge part 11 to the outside. Accordingly, the discharge port 10 is staggered from the discharge port 11 at about 360°, and this enables a sufficient silencing effect to be obtained.

When the pump is operated for a long period of time, a large quantity of abrasion powder of the vanes 7 is discharged from the discharge port 10 since the vanes 7 are rotated as they contact the inner surface of the inner wall of a center case 2. Substantially the whole amount of the discharged abrasion powder is collected in the first sealed compartment *9a*, and the quantity of the abrasion powder discharged into the second sealed compartment *9b* is very small as compared with that of the abrasion powder discharged into the first sealed compartment *9a*. The quantities of the abrasion powder discharged into the third and fourth sealed compartments *9c*, *9d* become smaller. Therefore, even when soundproof members are sealed in the second to fourth sealed compartments *9b–9d*, they are not clogged with the abrasion powder.

Accordingly, the embodiment of FIGS. 3 and 4 has the same effect as the embodiment of FIGS. 1 and 2. The abrasion powder of the vanes 7 does not substantially enter the second to fourth sealed compartments *9b*, *9c*, *9d*, and the interior of these compartments is not adversely affected by the abrasion powder. Hence, the pump-silencing effect can be improved greatly by sealing the soundproof members in the second to fourth compartments *9b*, *9c*, *9d*.

According to the present invention described above, in which the space used as a soundproof chamber is utilized also as a soundproof layer for the frictional sound of the vanes, the noise in a rotary vane pump can be minimized.

We claim:

1. A rotary vane pump, comprising:

a cylindrical center case, a rotor supported at both ends of said cylindrical center case on bearing means and adapted to be rotated in said center case, vane means displaceably mounted in said rotor, side covers fixed to both end surfaces of said center case so as to form compression spaces being rotated to carry out a pumping operation due to different volumes of different portions of said spaces defined by said cylindrical center case, said rotor, and said vane means and said side covers, a suction port formed in said cylindrical center case for communicating one of said compression spaces with the outside, moat-like groove means formed within said cylindrical center case and defining inner and outer circumferential walls so as to form a sealed chamber between said covers, and a discharge port means for communicating a pump chamber with the sealed chamber whereby a medium is discharged from the pump chamber through said discharge port means into said sealed chamber and then to the outside of said pump, wherein a plurality of partitions are provided in a portion of said sealed chamber to divide said sealed chamber into a plurality of sealed compartments, a passage means of a small cross-sectional area is provided for communicating adjacent compartment, soundproof members are provided in said sealed compartments, said soundproof members being sealed in second to last sealed compartments except for a first sealed compartment having said discharge port means in communication with the pump chamber.

2. A rotary vane pump according to claim 1, wherein a discharge port means is provided for communicating the sealed chamber with the outside of the pump, said sealed chamber extends over substantially an entire length of said center case, and wherein a position of said discharge port means communicating the pump chamber with the sealed chamber is staggered with respect to a discharge port means for communicating with an outside of the pump at an angle in a range of from not less than 180° and less than 360°.

* * * * *